US007707719B2

(12) United States Patent
Meister et al.

(10) Patent No.: US 7,707,719 B2
(45) Date of Patent: May 4, 2010

(54) METHOD FOR PROTECTING CONTACTS WITHIN A CONNECTOR ASSEMBLY

(75) Inventors: Douglas L. Meister, Loganville, GA (US); Ray D. Sturbaum, Loganville, GA (US)

(73) Assignee: Scientific-Atlanta, Inc., Lawrenceville, GA (US)

( * ) Notice: Subject to any disclaimer, the term of this patent is extended or adjusted under 35 U.S.C. 154(b) by 0 days.

(21) Appl. No.: 11/736,045

(22) Filed: Apr. 17, 2007

(65) Prior Publication Data

US 2007/0190855 A1 Aug. 16, 2007

Related U.S. Application Data

(62) Division of application No. 11/015,403, filed on Dec. 17, 2004, now Pat. No. 7,217,146.

(51) Int. Cl.
*H01R 43/20* (2006.01)

(52) U.S. Cl. ..... 29/876; 29/868; 29/874; 29/883; 385/92; 385/134; 439/135; 439/148; 439/271

(58) Field of Classification Search ..... 29/876, 29/868, 874, 883; 385/92, 134; 439/36, 439/135, 148, 204, 271, 535, 607
See application file for complete search history.

(56) References Cited

U.S. PATENT DOCUMENTS 5,243,678 A * 9/1993 Schaffer et al. ..... 385/134
5,580,268 A * 12/1996 Miyazawa ..... 439/352
6,273,729 B1 * 8/2001 Kelly ..... 439/36

* cited by examiner

*Primary Examiner*—Thiem Phan
(74) *Attorney, Agent, or Firm*—Lewinski Law Group LLC

(57) ABSTRACT

A method for protecting contacts within a receptacle housing of a connector assembly from becoming contaminated. An example method includes inserting a connector insert into the receptacle housing, the connector insert includes a body portion having an exterior configured to correspond to at least a portion of the interior of the receptacle housing of the connector assembly. The body portion of the insert includes an opening which extends into the body portion to receive the contacts and protect the contacts from the exterior environment surrounding the receptacle housing when at least a portion of the body portion is received within the receptacle housing.

9 Claims, 3 Drawing Sheets

METHOD FOR PROTECTING CONTACTS WITHIN A CONNECTOR ASSEMBLY

CROSS-REFERENCE TO RELATED APPLICATIONS

This application is a Divisional of U.S. utility application entitled "Connector Insert for Preventing Contamination" having Ser. No. 11/015,403, filed on Dec. 17, 2004 now U.S. Pat. No. 7,217,146, which is entirely incorporated herein by reference.

TECHNICAL FIELD

The present invention relates to the field of connectors and, more particularly, relates to preventing contamination of the contacts of the connector during the manufacturing process.

BACKGROUND OF THE INVENTION

Electronic devices typically include various types of receptacle-type connector assemblies which are installed during the manufacturing of the electronic device. For example, a computer or set-top box may include 1394 ports, sometimes referred to as "firewire" ports, or USB ports. Also, a newer connector, referred to as a HDMI (High Definition Multimedia Interface) connector assembly, integrates audio and video information into a single digital interface to be used with, for example, digital video disc (DVD) players, digital television (DTV), high definition TV (HDTV), set-top boxes, and other audio and/or video devices. Connectors such as these include contacts within the receptacle housing of the connector assembly. These contacts are typically made of gold and may easily become contaminated during the manufacturing of the electronic device. The HDMI connector, in particular, allows contamination to pass into the receptacle housing of the connector assembly through openings in the bottom of the receptacle housing. These openings in the bottom of the receptacle housing define resilient tabs that are utilized to retain the corresponding plug-type connector within the receptacle housing. This contamination often occurs from liquid flux, paste or solder that seeps, bubbles, wicks or splashes into the connector assembly through these openings or elsewhere in the receptacle housing while the connector assembly is soldered to an electrical board.

Consequently, these electronic devices fail because of the contaminated connector assemblies. The contaminated connector assemblies require replacing by hand which results in a costly rework of the electronic device. Therefore, what is needed is a means to protect the connector assembly's contacts from contamination during the manufacturing process.

BRIEF DISCRIPTION OF THE DRAWINGS

DETAILED DESCRIPTION

The present invention will be described more fully hereinafter with reference to the accompanying drawings in which like numerals represent like elements throughout the several figures, and in which an exemplary embodiment of the invention is shown. This invention may, however, be embodied in many different forms and should not be construed as being limited to the embodiments set forth herein; rather, the embodiments are provided so that this disclosure will be thorough and complete, and will fully convey the scope of the invention to those skilled in the art. The present invention is described more fully hereinbelow.

Figure 1:
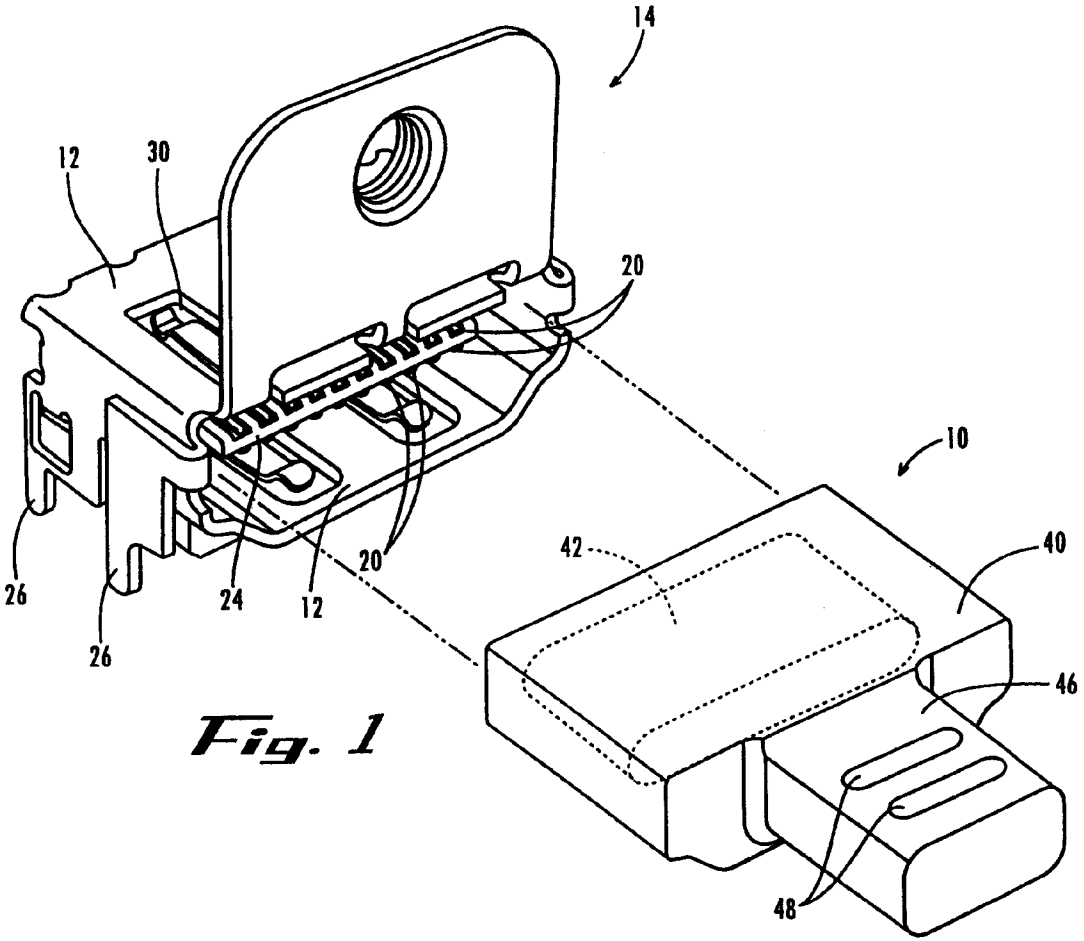
FIG. 1 illustrates a perspective view of one embodiment of an insert configured to be received within the receptacle housing of a connector assembly.
Figure 2:
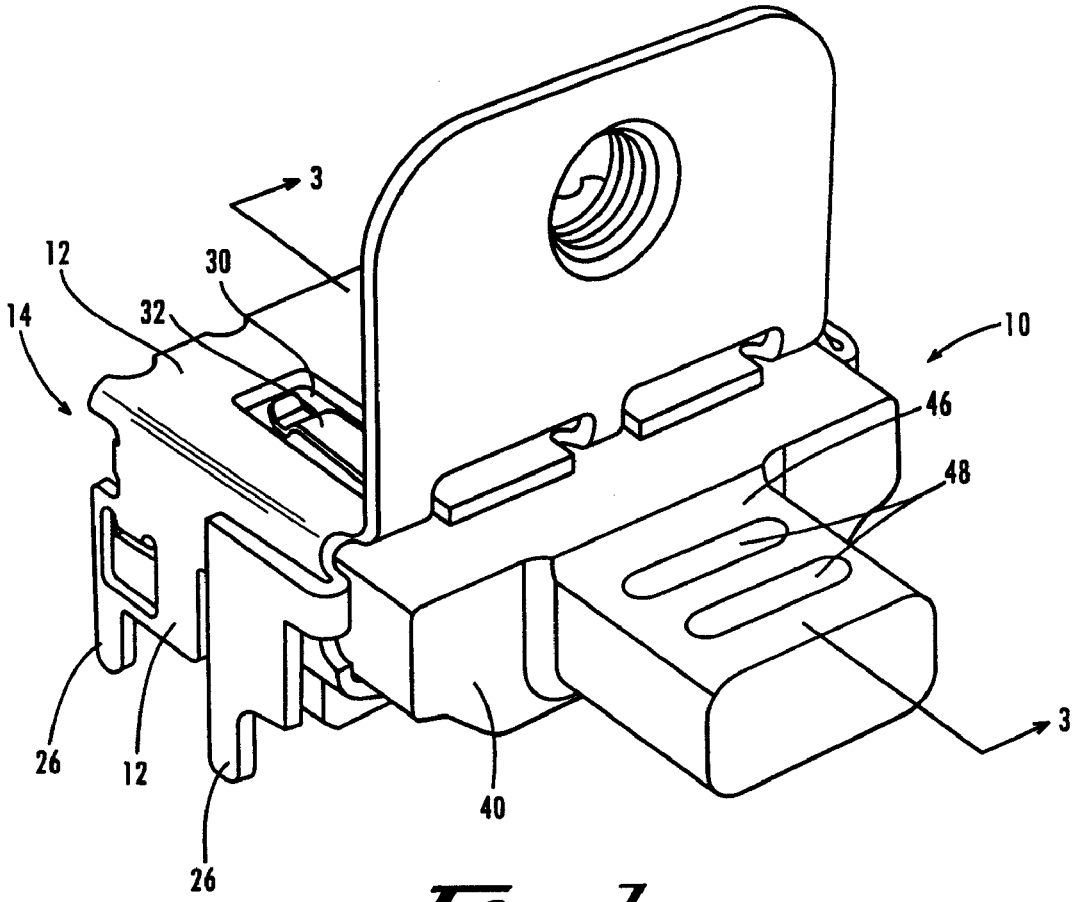
FIG. 2 illustrates the insert of FIG. 1 received within the connector assembly according to the present invention.
Figure 3:
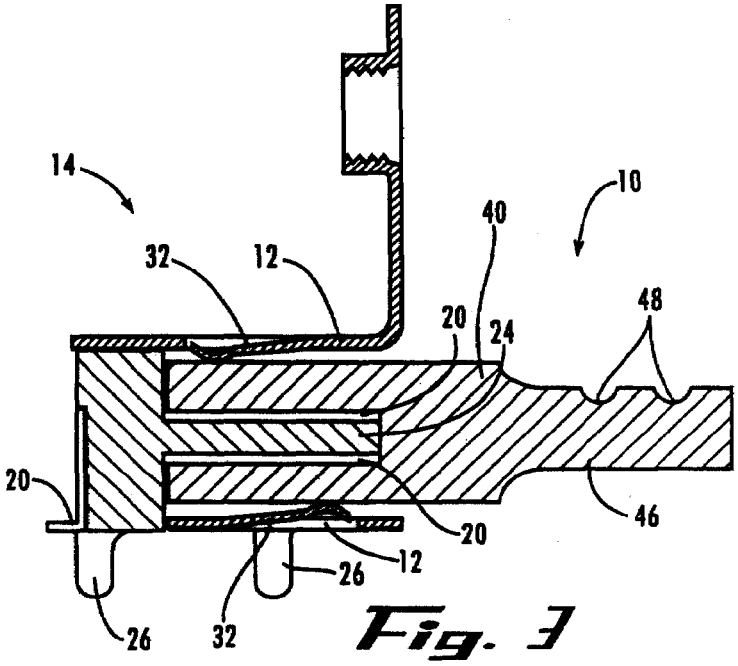
FIG. 3 illustrates is a cross-section view of the insert within the connector assembly taken along lines 3-3 of FIG. 2

FIG. 1 illustrates a perspective view of one embodiment of an insert 10 to be received and retained within a receptacle housing 12 of a connector assembly 14. The connector assembly 14 in FIGS. 1-3 generally depict a HDMI connector assembly which is for illustrative purposes only. The insert 10 of the present invention may be used with any type of connector assembly where it is desirable to prevent contacts within a receptacle housing from becoming contaminated. FIGS. 2 and 3 illustrate the insert 10 received and retained within the receptacle housing 12 of the connector assembly 14 to prevent contamination of electrical contacts 20.

As best shown in FIG. 1, the electrical contacts 20 are positioned along both sides of a central tongue portion 24. The tongue portion 24 is interposed between the contacts 20. The distal ends of the contacts 20 correspond with the distal end of the tongue portion 24. The receptacle housing 12 also includes a plurality of outwardly extending feet 26 which are utilized to secure the connector assembly 14 to an electrical board (not shown). Once these feet 26 are positioned in corresponding openings in an electrical board during the manufacturing process, the electrical board is passed through a hot bath of solder where the solder and liquid flux may pass through openings 30 defined on the top and bottom of the receptacle housing 12 of the connector assembly 14. Typically, these openings 30 define resilient tabs 32 which are used to retain the corresponding plug-type connector (not shown) within the receptacle housing 12 of the connector assembly 14. However, contamination other than solder and liquid flux may contaminate the contacts 20 which may pass into the receptacle housing 12 through other means during the manufacturing process as well as during shipment of the electrical devices.

Figure 4:
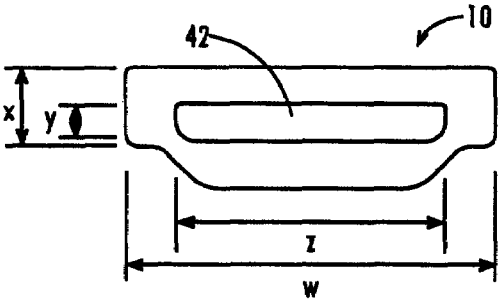
FIG. 4 illustrates an end view of one embodiment of the insert of the present invention.

The insert 10 may itself be referred to as a plug or connector, but the insert 10 does not have electrical components to make an electrical connection with any connector assembly such as connector assembly 14. The insert 10 is preferably made of Pollybutylene Terephalateor, commonly referred to as PBT (30% glass filled), with a UL rating of UL94V-0, or some other suitable material such as a heat resistant plastic. As best shown in FIG. 4, at least part of a body portion 40 of the insert 10 is configured or keyed to be received within the receptacle housing 12 and also has a central opening 42 configured or keyed to protect at least portions of the contacts 20 around the central tongue portion 24. Preferably, the exterior of the body portion 40 conforms to the inner confines of the receptacle housing 12 and the opening 42 of the body portion 40 conforms to the contacts 20.

In one embodiment, the body portion 40 obstructs contaminates from passing through the openings 30 as well as through the front face of the connector assembly 14 when the body portion 40 is within the receptacle housing 12. In another embodiment, the body portion 40 is configured to be received and retained only within a lower portion of the receptacle housing 12 below the tongue portion 24 such that any openings 30 on the bottom of the receptacle house 12 are blocked to prevent contamination, while any openings 30 on the top of the receptacle housing 12 above the tongue portion 24 remain unobstructed.

For example, in one embodiment, if the connector assembly 14 is a HDMI connector, the bottom edges of the body portion 40 are truncated or arched inward as best seen from the end view shown in FIG. 4. The bottom edges of the opening 42 are preferably also truncated or arched inward in order to accommodate the contacts 20 and tongue portion 24 while the exterior of the insert 10 mattingly corresponds with the interior of the receptacle housing 12. However, the opening 42 and the exterior of the body portion 40 of the insert 10 may be configured differently depending upon the type of the connector assembly the insert is intended to be used with.

In one embodiment for use with a HDMI connector assembly, the body portion 40 has a height x of approximately 0.175 inches which allows the insert 10 to be received and retained within the receptacle housing 12 in a secure manner. The depth of the opening 42 through the body portion 40 could be any depth suitable for receiving the contacts 20 and central tongue portion 24. For example, the depth of the opening 42 could be approximately 0.275 inches. Also, for example, the height y of the opening 42 could be approximately 0.054 inches in order to satisfactorily accommodate the contacts 20 and the central tongue portion 24. FIG. 4 best illustrates the proximal end of the insert 10 having height x and an opening with height y.

Figure 5:
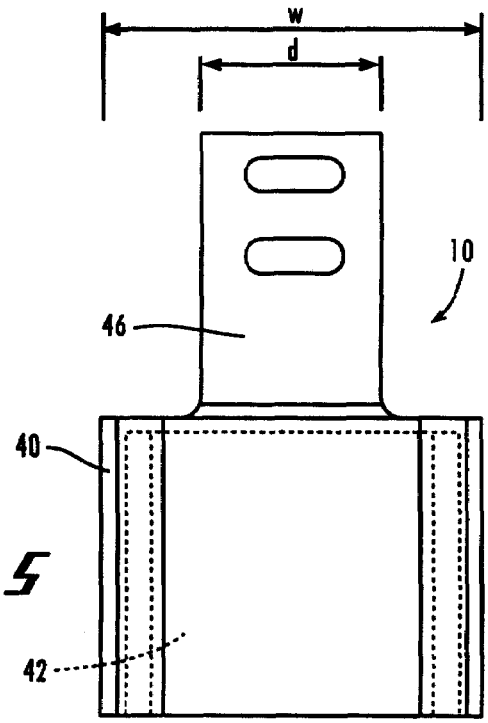
FIG. 5 illustrates a bottom view of one embodiment of the insert of the present invention.

FIGS. 4 and 5 also illustrate a width w of the body portion 40. In one embodiment, such as when the insert 10 is used with a HDMI connector, the overall width of the body portion 40 is approximately 0.547 inches. The opening 42, on the other hand, has a width z as shown in FIG. 4 which is approximately 0.452 inches.

In one embodiment, when the insert 10 is received and retained within the receptacle housing 12 of the connector assembly 14, the body portion 40 has a length which allows it to extend outward from the face of the connector assembly 14 as shown in FIGS. 1-3. This allows the insert 10 to be more easily withdrawn from the connector assembly 14 by allowing the body portion 12 itself to be grasped by hand or by a tool. Preferably, however, the insert 10 also includes an elongated portion 46 as best shown in FIG. 5 which outwardly extends from the body portion 40 to facilitate withdrawal of the insert 10 from the connector assembly 14. The elongated portion 46 may be any length, but is preferably a length which permits itself to be grasped by hand or by a tool. FIG. 5 also illustrates the elongated portion 46 having a width d relative the body portion 40. The width d could be, for example, approximately 0.25 inches. The elongated portion 46 may be also utilized for facilitating the insertion of the insert 10 within the receptacle housing 12 in a secured manner.

In another embodiment, the insert 10 may include only the body portion 40 and therefore have no elongated portion 46. In such case, the body portion 40 may include a recessed portion or other means suitable for allowing the body portion 40 to be hooked or otherwise grasped with a tool so that the insert 10 may be withdrawn from the connector assembly 14. In yet another embodiment, the insert may include a withdraw strap that outwardly extends from the body portion 40. In any case, to facilitate a low profile design, nothing extends significantly beyond the exterior of the connector assembly 14, such as an electrical cord, when the connector assembly 14 with insert 10 is installed in an electrical device.

The elongated portion 46 may include one or more friction bearing surfaces to further facilitate the withdrawal of the insert 10 from the connector assembly 14. For example, one or more divots 48 on the surface of the elongated portion 46 may allow the insert 10 to be more easily grasped by the fingers. FIGS. 1-3 and 5 show a pair of divots 48 displaced from one another, on one side of the elongated portion 46, and adjacent the distal end of the elongated portion 46.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

What is claimed is:

1. A method for protecting contacts within a connector assembly having electrical components while said connector assembly is being mounted to a circuit board, said method comprising the steps of:

inserting a body portion of a connector insert free of electrical components into an interior of a receptacle housing of said connector assembly without engaging the electrical components of the connector assembly, wherein the receptacle housing has at least one opening defining a resilient tab configured to retain a connector, wherein the connector assembly has a tongue portion interposed between electrical contacts, the tongue and electrical contacts extending over the at least one opening of the receptacle housing, and wherein the connector insert has a central opening configured to receive the tongue portion and electrical contacts;

receiving the tongue portion and the electrical contacts of the connector assembly within the central opening of the connector insert so that the body portion of the connector insert blocks the at least one opening of the receptacle housing to preclude contaminants from passing from the exterior of the receptacle housing into the interior of the receptacle housing through the at least one opening;

protecting the electrical contacts within said receptacle housing from the exterior environment surrounding said receptacle housing as a result of said connector insert being received within said receptacle housing; and mounting said connector assembly with said connector insert within said receptacle housing to a circuit board.

2. The method of claim 1 further comprising the step of passing said connector assembly with said connector insert therein through a solder bath, wherein said connector insert precludes solder from contaminating said electrical contacts of said connector assembly.

3. The method of claim 1 further comprising the step of removing said connector insert from said connector assembly after said connector is mounted to said circuit board.

4. The method of claim 1 further comprising the steps of retaining said connector insert in said connector assembly to protect said electrical contacts of said connector assembly after manufacturing an electrical device as well as during shipment of said electrical device.

5. The method of claim 1, further comprising:

mounting feet of the connector assembly to the circuit board.

6. The method of claim 1, further comprising:

wherein the at least one opening of the receptacle housing comprises a plurality of openings provided in the receptacle housing, the step of extending the body portion to block at least one of the openings and leaving at least one of the openings unobstructed.

7. The method of claim 1, further comprising:

wherein the at least one of the openings in the receptacle housing is provided at a top of the receptacle and at least one of the openings is provided at a bottom of the receptacle housing, the step of extending the body portion to block the opening at the bottom of the receptacle housing and leaving the opening at the top of the receptacle housing unobstructed.

8. The method of claim 1, further comprising:

wherein the at least one opening of the receptacle housing is provided above the tongue and at least one opening of the receptacle housing below the tongue, further comprising:

extending the body portion of the insert to block the at least one opening below the tongue and leaving openings above the tongue unobstructed.

9. The method of claim 1, further comprising extending the body portion of the insert between the tongue and the resilient tab.

* * * * *